US010902801B2

(12) United States Patent
Shan

(10) Patent No.: US 10,902,801 B2
(45) Date of Patent: Jan. 26, 2021

(54) DRIVING METHOD AND APPARATUS FOR DISPLAY APPARATUS

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 320 days.

(21) Appl. No.: 15/750,657

(22) PCT Filed: Dec. 8, 2017

(86) PCT No.: PCT/CN2017/115282

§ 371 (c)(1),
(2) Date: Feb. 6, 2018

(87) PCT Pub. No.: WO2019/071782

PCT Pub. Date: Apr. 18, 2019

(65) Prior Publication Data

US 2020/0090601 A1 Mar. 19, 2020

(30) Foreign Application Priority Data

Oct. 10, 2017 (CN) ..... 2017 1 0936858

(51) Int. Cl.
*G09G 3/36* (2006.01)

(52) U.S. Cl.
CPC ... *G09G 3/3607* (2013.01); *G09G 2320/0242* (2013.01)

(58) Field of Classification Search
CPC ..... G09G 3/3607
USPC ..... 345/204, 420, 590; 348/222.1, 602; 382/164
See application file for complete search history.

(56) References Cited

U.S. PATENT DOCUMENTS

2005/0185840 A1* 8/2005 Sugiura ..... G06T 11/001 382/167
2006/0038800 A1* 2/2006 Tokioka ..... G09G 3/3283 345/204
2007/0040773 A1* 2/2007 Lee ..... G09G 3/3283 345/77
2007/0132674 A1* 6/2007 Tsuge ..... G09G 3/3283 345/77
2007/0262985 A1* 11/2007 Watanabe ..... G06T 5/008 345/420

(Continued)

FOREIGN PATENT DOCUMENTS

CN 107154249 * 9/2017 ..... G09G 3/3611

*Primary Examiner* — Prabodh M Dharia
(74) *Attorney, Agent, or Firm* — Platinum Intellectual Property LLP

(57) ABSTRACT

The present disclosure provides a driving method and apparatus for a display apparatus. The driving method includes: selecting one of at least two partitions divided in a display interface, marking the one as a selected partition; calculating a chroma and a hue value of the selected partition; adjusting initial gray scale parameters of sub-pixel units of each of the pixel units according to the chroma and the hue value, acquiring an initial input signal of the selected partition, and adjusting the gray scale parameters corresponding to the initial input signal according to the initial input signal and the initial gray scale parameters of the sub-pixel units.

16 Claims, 6 Drawing Sheets

(56) References Cited

U.S. PATENT DOCUMENTS

| | | | | |
|---|---|---|---|---|
| 2009/0237567 | A1* | 9/2009 | Tsao | H05B 45/20 348/602 |
| 2010/0066714 | A1* | 3/2010 | Ozaki | G09G 3/3266 345/207 |
| 2010/0072900 | A1* | 3/2010 | Deppe | H05B 45/20 315/151 |
| 2010/0111408 | A1* | 5/2010 | Matsuhira | G06T 3/4038 382/164 |
| 2011/0157213 | A1* | 6/2011 | Takeyama | H04N 9/68 345/590 |
| 2011/0181746 | A1* | 7/2011 | Free | G06K 9/00234 348/222.1 |
| 2013/0097099 | A1* | 4/2013 | Clark | G06Q 30/04 705/400 |
| 2015/0054722 | A1* | 2/2015 | Kanda | G09G 3/3233 345/77 |
| 2016/0379594 | A1* | 12/2016 | Cho | G09G 5/04 345/601 |
| 2017/0004774 | A1* | 1/2017 | Kumeta | G09G 3/3233 |
| 2017/0061865 | A1* | 3/2017 | Park | G09G 3/325 |
| 2018/0075798 | A1* | 3/2018 | Nho | G09G 3/3233 |
| 2018/0211603 | A1* | 7/2018 | Lu | G09G 3/3233 |
| 2018/0374428 | A1* | 12/2018 | Chen | G09G 3/3413 |
| 2019/0385519 | A1* | 12/2019 | Yan | G09G 3/3233 |

* cited by examiner

Red

Green

DRIVING METHOD AND APPARATUS FOR DISPLAY APPARATUS

FIELD OF THE INVENTION

The present disclosure relates to a field of display technology, and particularly relates to a driving method and apparatus for a display apparatus.

BACKGROUND OF THE INVENTION

For a liquid crystal displayer (LCD), due to the relevance between refractive index and wavelength, the transmittance of different wavelengths is related to the phase delay, which shows different degrees of performance of the transmittance and the wavelength. In addition, different wavelength phase delays will also have varying degrees of change that impacts the transmittance of different wavelengths with voltage drive changing.

Taking the characteristics of displayer with Vertical Alignment (VA) mode as an example, when the voltage drive changes from a high voltage to a low voltage, the color chroma is obviously affected. Specifically, the color saturation is bright while the voltage is high, and the color brightness drops when the voltage drives down. Taking an 8-bit displayer as an example, the 8-bit displayer can display different gray scales from 0 to 255, the saturation is obviously quite bright at high gray scales, whilst the color brightness drops at low gray scales.

SUMMARY

Accordingly, it is necessary to provide a driving method and apparatus for a display apparatus, which can effectively improve the color casted image quality.

A driving method for a display apparatus includes:

selecting one of at least two partitions divided in a display interface, and marking the one as a selected partition, the selected partition includes at least two pixel units;

calculating a chroma and a hue value of the selected partition;

adjusting initial gray scale parameters of sub-pixel units of each of the pixel units in the selected partition according to the chroma and the hue value of the selected partition, the gray scale parameters includes a gray scale value, a gray scale voltage value, or a gray scale current value; and acquiring an initial input signal of the selected partition, and adjusting the gray scale parameters corresponding to the initial input signal according to the initial input signal and the initial gray scale parameters of the sub-pixel units.

A driving apparatus of a display apparatus includes:

a selecting module used to select one of at least two partitions divided in a display interface, and used to mark the one as a selected partition, the selected partition includes at least two pixel units;

a calculating unit used to calculate a chroma and a hue value of the selected partition;

a first adjusting module used to adjust initial gray scale parameters of sub-pixel units of each of the pixel units in the selected partition according to the chroma and the hue value of the selected partition, the gray scale parameters comprise a gray scale value, a gray scale voltage value, or a gray scale current value; and a second adjusting module used to acquire an initial input signal of the selected partition, and used to adjust the gray scale parameters corresponding to the initial input signal according to the initial input signal and the initial gray scale parameters of the sub-pixel units.

A driving apparatus of a display apparatus includes:

a dividing module used to divide a display interface into at least two partitions, each of the partitions includes i*j pixel units, i and j are positive integers, and i*j is greater than or equals to 2;

a selecting module used to select one of the at least two partitions divided in the display interface, and used to mark the one as a selected partition, the selected partition includes at least two pixel units;

an acquiring unit used to acquire a sub-pixel unit value of each of the pixel units in the selected partition;

an average value calculating unit used to calculate an average value of the sub-pixel units of each of the pixel units in the selected partition; and a chroma and a hue value calculating unit used to calculate the chroma and the hue value of the selected partition according to the average value of the sub-pixel units.

a first adjusting module used to adjust initial gray scale value of the sub-pixel units of each of the pixel units in the selected partition according to the chroma and the hue value of the selected partition; and a second adjusting module used to acquire an initial input signal of the selected partition, and used to adjust the gray scale value corresponding to the initial input signal according to the initial input signal and the initial gray scale value of the sub-pixel units.

A display apparatus includes the aforementioned driving apparatus of the display apparatus.

According to the driving method of the display apparatus, the driving apparatus, and the display apparatus, one of at least two partitions divided in the display interface is selected, the one is marked as the selected partition, the chroma and the hue value of the selected partition are calculated, and the RGB initial gray scale parameters of each of the pixel units in the selected partition are adjusted according to the chroma and the hue value of the selected partition, the initial input signal of the selected partition is acquired, and the gray scale parameters corresponding to the initial input signal are adjusted according to the initial input signal and the RGB initial gray scale parameters. In the whole process, the chroma and the hue value of each of the pixel units of the partition are calculated to adjust the gray scale parameters corresponding to the RGB input signal of the partition, which can significantly improve the color cast image quality of the display interface.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. The accompanying drawings in the following description are only some embodiments of the present invention, and persons of ordinary skill in the art can derive other obvious variations from the accompanying drawings without creative efforts.

DETAILED DESCRIPTION OF THE EMBODIMENTS

Embodiments of the present disclosure are described more fully hereinafter with reference to the accompanying drawings, in which some embodiments of the present disclosure are shown. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Unless otherwise defined, all terms (including technical and scientific terms) used herein have the same meaning as commonly understood by one of ordinary skill in the art to which this invention belongs. The terminology used herein is for the purpose of describing particular embodiments only and is not intended to be limiting of the present disclosure. It will be further understood that the term "and/or" is understood to encompass various alternative orientations.

For a display apparatus (such as a liquid crystal displayer (LCD)), due to the relevance between refractive index and wavelength, the transmittance of different wavelengths is related to the phase delay, which shows different degrees of performance of the transmittance and the wavelength. In addition, different wavelength phase delays will also have varying degrees of change that impacts the transmittance of different wavelengths with the voltage drive changing. Such as the CIE (Commission Internationale de L'Eclairage) 1976 chromaticity diagram, in terms of the characteristics of display with VA mode, when the voltage drive changes from a high voltage to a low voltage, the color chroma is obviously affected. Specifically, the color saturation is bright while the voltage is high, and the color brightness drops when the voltage drives down. In other words, for an 8 bit display that can display different gray scales from 0 to 255, the saturation is obviously quite bright at high gray scales, whilst the color brightness drops at low gray scales.

Figure 1:
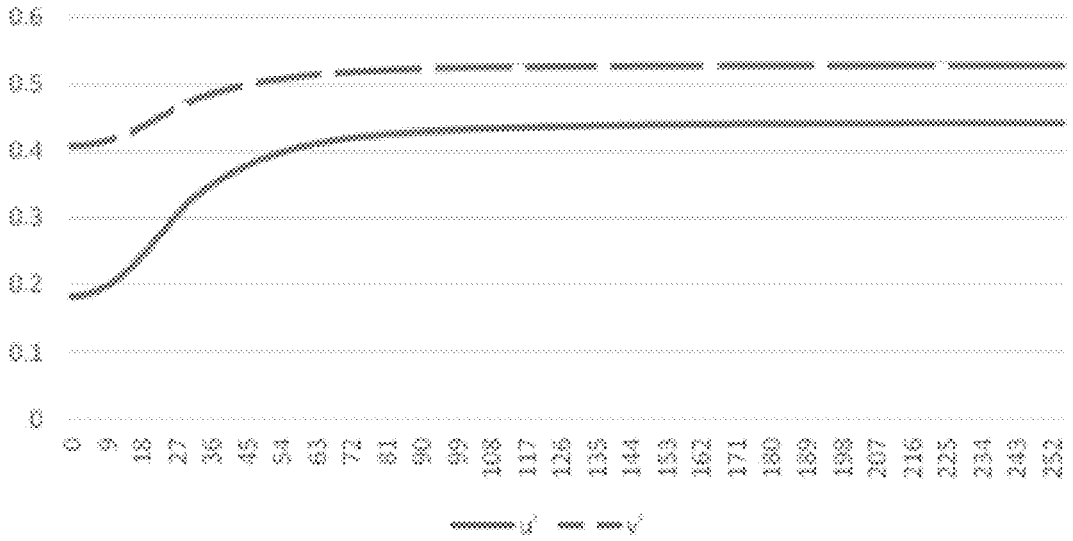
FIG. 1 is a graphic diagram illustrating a chromaticity variation curve of red.
Figure 2:
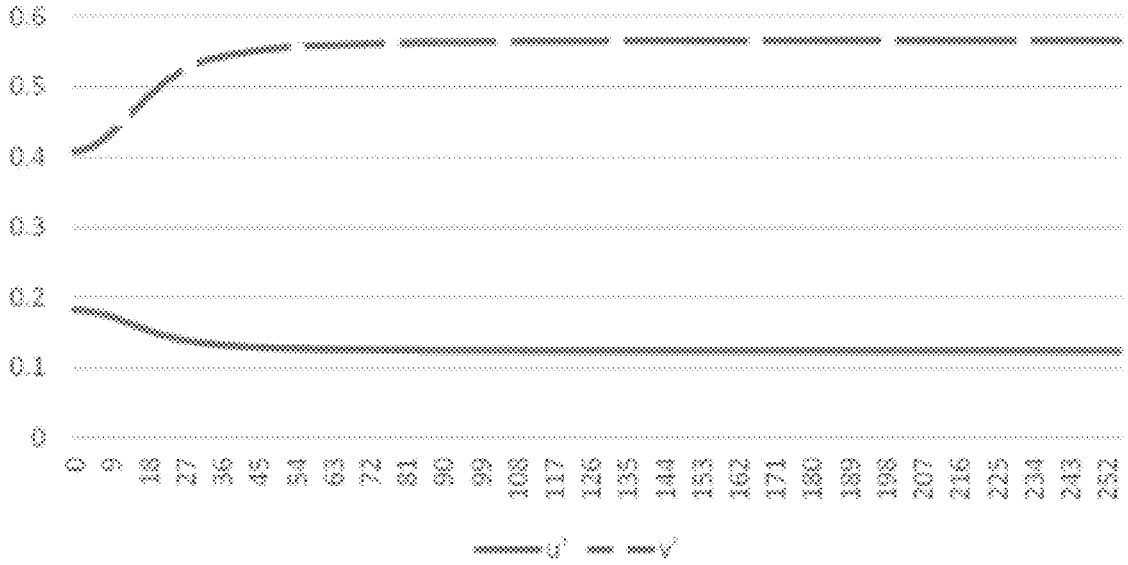
FIG. 2 is a graphic diagram illustrating a chromaticity variation curve of green.
Figure 3:
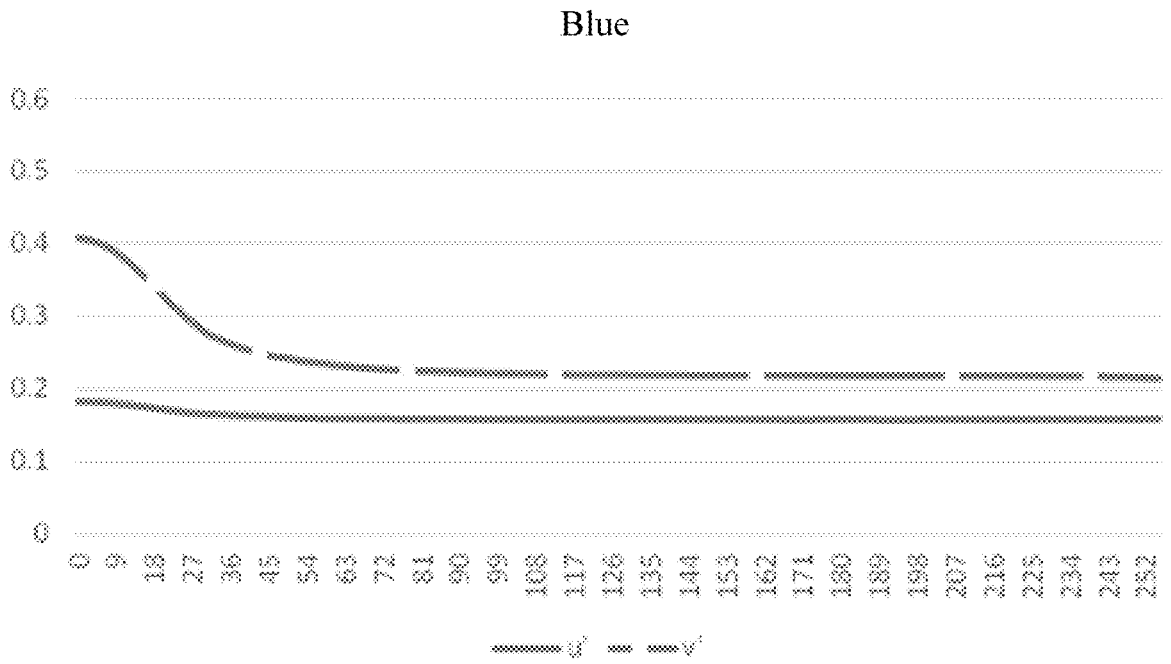
FIG. 3 is a graphic diagram illustrating a chromaticity variation curve of blue.

In further studies, referring to FIGS. 1, 2, and 3, when a V-T curve of a panel is designed in the published version 2.2, respective CIE 1976 chromaticity of RGB (red, green, blue) varies. It can be observed that, at gray scale 56, the color brightness of R starts to drop due to the different phase relay ratios and the GB sub-pixel light leakage; at the gray scale 32, the color brightness of G starts to drop due to the different phase relay ratios and the RB sub-pixel light leakage; and at the gray scale 60, the color brightness of B starts to drop due to the different phase relay ratios and the RG sub-pixel light leakage. In further studies, the drop of color brightness of each color of RGB also reflects on an angle of view observation. Horizontally, a trend of the color brightness of RGB varying with the gray scales observed at an angle of 60 degree is the same as the trend at a front angle of view, the saturation at high voltage is quite bright, whilst the color brightness drops when the voltage drives down.

In further studies, for the color cast variation of representative color schemes in display apparatus in large angle and front angle of view, it is obviously found that the color schemes biased to R, G, B colors have severer color casts than other color schemes in large angle of view. Therefore, fixing the color cast deficiencies in R, G, and B colors can significantly increase the improvement of overall color cast in large angle of view.

Based on the above theory, it is necessary to adjust gray scales of R, G, and B colors to significantly improve the color cast of the display interface.

Figure 4:
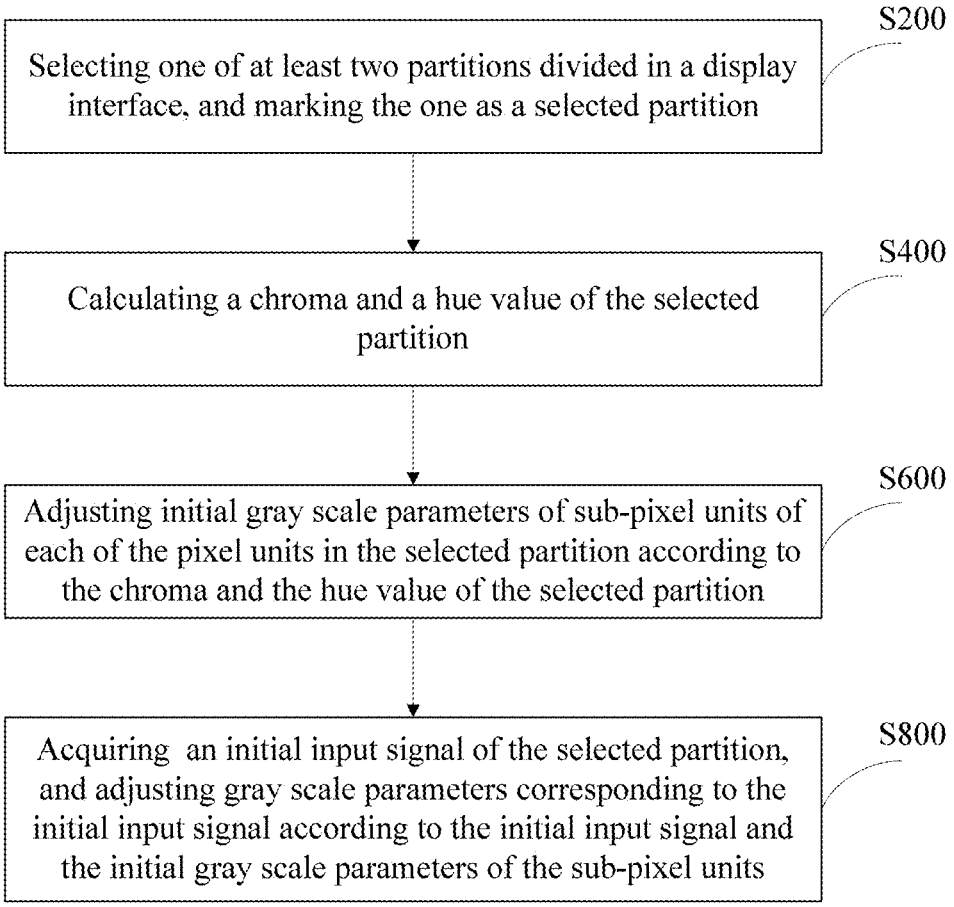
FIG. 4 is a flowchart of a driving method for a display apparatus according to one of the embodiments.

Referring to FIG. 4, a driving method for a display apparatus includes steps as follows:

In step S200, one of at least two partitions divided in a display interface is selected, the one is marked as a selected partition, and the selected partition includes at least two pixel units.

At least two partitions are divided in the display interface, and each of the partitions includes at least two pixel units. Specifically, each of the partitions can include the same number of pixel units, and for example, each of the partitions can both include i*j pixel units.

In step S400, a chroma and a hue value of the selected partition are calculated.

Figure 5:
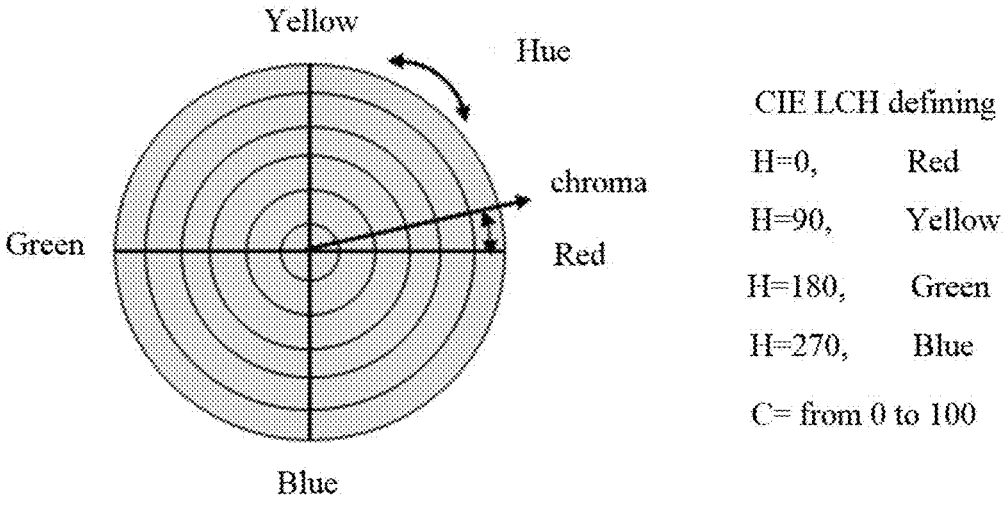
FIG. 5 is a schematic diagram of a CIE LCH color space model.

The chroma and the hue value of the display interface can be characterized directly by CIE LCH color space system. The CIE LCH color space system uses L for brightness, C for the chroma, and H for cylinder coordinates of the hue. Specifically, referring to FIG. 5, in the CIE LCH color space system, the CIE specification is a function of tricolor space coordinates of R, G and B, respectively, L=f1 (R, G, B), C=f2 (R, G, B), H=f3 (R, G, B). Where H is a color representative, using 0° to 360° to represent the color rendering of different hues, where 0° is defined as red, 90° is defined as yellow, 180° is defined as green, 270° is defined as blue, C is the color chroma representing the brightness degree of color, a range of C is from 0 to 100, 100 represents the most bright color, and to some extent a value of C is rendering of the display apparatus displaying the high and low voltage signals.

Figure 6:
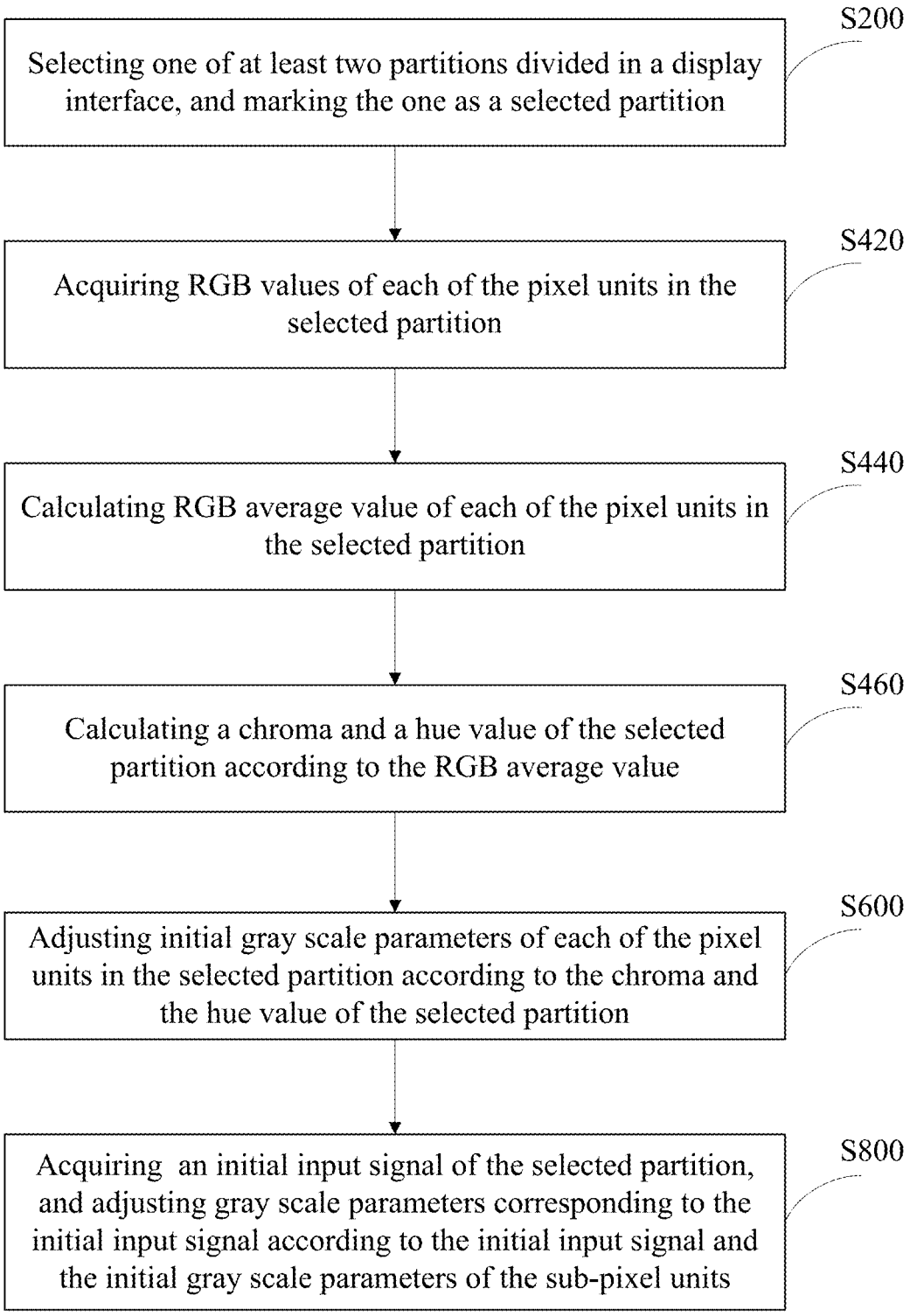
FIG. 6 is a flowchart of a driving method for a display apparatus according to one of the embodiments.

Optionally, referring to FIG. 6, according to an embodiment, the step S400 includes:

In step S420, RGB values of each of the pixel units in the selected partition are acquired;

In step S440, a RGB average value of each of the pixel units in the selected partition is calculated;

In step S460, a chroma and a hue value of the selected partition are calculated according to the RGB average value.

In the display interface, each of the pixel units has its own corresponding RGB value. It is necessary to separately acquire the RGB values of the pixel units in the selected section. For the acquired RGB values, RGB average values of each of the pixel units in the selected section are calculated, and the chroma and the hue value of the selected partitions are calculated according to the RGB average values, and a calculation function of the chroma and the hue in the LCH color space system. Specifically, a functional expression of calculating the chroma and the hue value of the selected partition is:

$$C=f2\{\text{Ave } R,\text{Ave } G,\text{Ave } B\}$$

$$H=f3\{\text{Ave } R,\text{Ave } G,\text{Ave } B\}$$

In the functional expression, Ave R, Ave G, and Ave B are respectively an average value of red sub-pixel units, an average value of green sub-pixel units, and an average value of blue sub-pixel units. f2 is a calculation function of chroma C in a brightness-chroma-hue model, and f3 is a calculation function of hue H in the brightness-chroma-hue model.

In step S600, RGB initial gray scale parameters of each of the pixel units in the selected partition are adjusted according to the chroma and the hue value of the selected partition, where the gray scale parameters includes a gray scale value, a gray scale voltage value, or a gray scale current value.

The gray scale parameter can be characterized by the gray scale value, which can also be characterized by the gray scale voltage value, or the gray scale current value. The gray scale value, the gray scale voltage value, and the gray scale current value have mutual correspondence. In other words, one gray scale value can accurately correspond to one gray scale voltage value, and also can accurately correspond to one gray scale current value, and vice versa. In different display apparatuses, different gray scale parameters are used for display control. For example, for a LCD, the gray scale voltage is generally selected as the gray scale parameter for performing display control. For an Organic Light-Emitting Diode (OLED), the gray scale current value is generally selected as the gray scale parameter for performing display control. Therefore, in step S600, any one of the gray scale value, the gray scale voltage value, or the gray scale current value can be selected as the gray scale parameter for the subsequent operation. It should be noted that the type of the gray scale parameter selected in step S600 should be the same as the type of the gray scale parameters selected in subsequent steps. In other words, when the gray scale value is selected as the gray scale parameter in step S600, the gray scale parameter is also the gray scale value in the subsequent processing step.

The different chroma and the different hue values in partitions correspond to different initial gray scale parameters. Specifically, the initial gray scale parameters corresponding to different chroma and hue values have been defined in the LCH color space system, which are divided into six section values, the corresponding and specific values are as follows:

The gray scale parameter is the gray scale value.

When $0°<H\leq 45°$ or $315°<H\leq 360°$, and $CTL1\leq C\leq CTH2$, RGB initial gray scale values of the pixel units are R1, G1, and B1, respectively;

When $45°<H\leq 135°$, and $CTL3\leq C\leq CTH4$, the RGB initial gray scale values of the pixel units are R2, G2, and B2, respectively;

When $135°<H\leq 205°$, and $CTL5\leq C\leq CTH6$, the RGB initial gray scale values of the pixel units are R3, G3, and B3, respectively;

When $205°<H\leq 245°$, and $CTL7\leq C\leq CTH8$, the RGB initial gray scale values of the pixel units are R4, G4, and B4, respectively;

When $245°<H\leq 295°$, and $CTL9\leq C\leq CTH10$, the RGB initial gray scale values of the pixel units are R5, G5, and B5, respectively;

When $295°<H\leq 315$, and $CTL11\leq C\leq CTH12$, the RGB initial gray scale voltage values of the pixel units are R6, G6, and B6, respectively; where the CTL1 and the CTH2, the CTL3 and the CTH4, the CTL5 and the CTH6, the CTL7 and the CTH8, the CTL9 and the CTH10, and the CTL11 and the CTH12 are respective color ranges required to be improved, and the color ranges are determined according to preset color cast image quality demand.

The gray scale parameter is the gray scale voltage value.

When $0°<H\leq 45°$ or $315°\leq H\leq 360°$, and $CTL1\leq C\leq CTH2$, RGB initial gray scale voltage values of the pixel units are VR1, VG1, and VB1, respectively;

When $45°<H\leq 135°$, and $CTL3\leq C\leq CTH4$, the RGB initial gray scale voltage values of the pixel units are VR2, VG2, and VB2, respectively;

When $135°<H\leq 205°$, and $CTL5-C\leq CTH6$, the RGB initial gray scale voltage values of the pixel units are VR3, VG3, and VB3, respectively;

When $205°<H\leq 245°$, and $CTL7\leq C\leq CTH8$, the RGB initial gray scale voltage values of the pixel units are VR4, VG4, and VB4, respectively;

When $245°<H\leq 295°$, and $CTL9\leq C\leq CTH10$, the RGB initial gray scale voltage values of the pixel units are VR5, VG5, and VB5, respectively;

When $295°<H\leq 315°$, and $CTL11\leq C\leq CTH12$, the initial gray scale voltage values of the pixel units are R6, G6, and B6, respectively; the CTL1 and the CTH2, the CTL3 and the CTH4, the CTL5 and the CTH6, the CTL7 and the CTH8, the CTL9 and the CTH10, and the CTL11 and the CTH12 are respective color ranges required to be improved, the color ranges are determined according to preset color cast image quality demand.

$0°<H\leq 45°$ or $315°<H\leq 360°$ corresponds to red hue range, $45°<H\leq 135°$ corresponds to yellow hue range, $135°<H\leq 205°$ corresponds to green hue range, $205°<H\leq 245°$ corresponds to cyan hue range, $245°<H\leq 315°$ corresponds to blue hue range, and $295°<H\leq 315°$ corresponds to purple hue range. In practical applications, taking an 8-bit display apparatus as an example, the corresponding gray scale range is from 0 to 255. According to the principle of three primary colors, the RGB primary colors correspond to red, and the corresponding gray scales are red (255, 0, 0), the green (0, 255, 0), blue (0, 0,255); red+green=yellow (255, 255, 0), red+blue=magenta (255, 0, 255), green+blue=cyan (0, 255, 255).

In step S800, initial input signal of the selected partition is selected, and gray scale parameter corresponding to the initial input signal is adjusted according to the initial input signal and RGB initial gray scale parameters.

The initial input signal contains its corresponding gray scale information, the corresponding gray scale information includes its current initial gray scale parameter and termination point signal corresponding to the initial input signal, etc. A range corresponding to the gray scale value of the input signal of 8-bit display apparatus is from 0 to 255, a gray scale voltage value thereof is from V0 to V255, a gray scale value corresponding to the termination point signal is 255. A range corresponding to the gray scale value of the input signal of 10-bit display apparatus is from 0 to 510, a gray scale voltage value thereof is from V0 to V510, a gray scale value corresponding to the termination point signal is 510. A range corresponding to the gray scale value of the input signal of 12-bit display apparatus is from 0 to 1020, a gray scale voltage value thereof is from V0 to V1020, a gray scale value corresponding to the termination point signal is 1020.

If the gray scale parameter is the gray scale value in step S600, the gray scale value corresponding to the initial input signal can be adjusted based on the gray scale value corresponding to the initial input signal, the termination point signal and the RGB initial gray scale value corresponding to the initial input signal. According to an embodiment, the step of adjusting the gray scale corresponding to the initial input signal according to the initial input signal and the RGB initial gray scale includes: Step 1: identifying the initial gray scale value and the termination point signal corresponding to the initial input signal. Taking a certain initial input signal X as an example, the initial input signal X can be parsed to learn the corresponding initial gray scale value (for example, 2,), and the termination point signal corresponding to the initial input signal X can further be identified. When the initial input signal X is for the 8-bit display apparatus, its corresponding gray scale value range is from 0 to 255, its termination point signal is (R255, G255, B255). Step two: the gray scale value corresponding to the adjusted initial input signal is determined as f {the initial gray scale value, γ, initial gray scale value, the termination point signal} according to the initial gray scale value and the termination point signal corresponding to the initial input signal, and RGB initial gray scale values, γ is a value affecting full gray scale brightness curve profile, f is a preset function determined according to a brightness corresponding to the initial gray scale, a brightness corresponding to the termination point signal, and the value γ affecting the full gray scale brightness curve profile. Assuming that the initial gray scale value of the initial input signal X is 2, and the termination point signal thereof is (R255, G255, B255), and the initial gray scale value is determined as (R1, G1, B1) in step S600, such that, for R, the corresponding gray scale value is f {2, γ, R1, R255}; for G, the corresponding gray scale value is f {2, γ, G1, G255}; for B, the corresponding gray scale value is {2, γ, B1, B255}. γ is the value affecting the full gray scale brightness curve profile, and the value can be acquired directly based on historical experience data.

If the gray scale parameter is the gray scale voltage value in the step S600, the gray scale voltage value corresponding to the full gray scale of the initial input signal is acquired according to the acquired initial input signal of the selected partition. The gray scale voltage value corresponding to each of the gray scales of the initial input signal is adjusted according to the adjusted RGB initial gray scale voltage values. Specifically, the initial input signal of the selected partition corresponds to full gray scale, for example, corresponds to from 0 to 255 gray scales, i.e., the initial gray scale of RGB is (0,0,0), and the final gray scale is (255, 255, 255), the corresponding initial gray scale value is (V0, V0, V0), the corresponding final gray scale value is (V255, V255, V255). The adjusted RGB initial gray scale voltage value is acquired after step S600. The initial gray scale voltage value serves as a starting point to adjust the gray scale voltage value corresponding to each of the gray scales in the initial input signal. Furthermore, the gray scale parameter is the gray scale voltage value, and the gray scale voltage value increased for each of the gray scales in the gray scale voltage value corresponding to each of the adjusted gray scales is a difference value between gray scale voltages corresponding to a current gray scale and a previous gray scale in the initial input signal before adjustment. It is assumed that the initial gray scale voltage value of the adjusted RGB initial input signal is determined as (VR1, VG1, VB1) in step S600, such that the initial gray scale voltage value corresponding to the initial input signal 1 before adjustment is (V1, V1, V1), and the gray scale voltage value corresponding to the adjusted input signal 1 is (VR1+(V1−V0), VG1+(V1−V0), VB1+(V1−V0).

If the gray scale parameter is the gray scale current value, a similar processing manner as described above for the gray scale voltage value may be employed, and the voltage value can be directly replaced by the current value, and the details are not described herein again.

According to the driving method of the display apparatus, one of at least two partitions divided in the display interface is selected, the one is marked as the selected partition. The chroma and the hue value of the selected partition are calculated. The RGB initial gray scale parameters of each of the pixel units in the selected partition are adjusted according to the chroma and the hue value of the selected partition, the initial input signal of the selected partition is acquired. The gray scale parameters corresponding to the initial input signal are adjusted according to the initial input signal and the RGB initial gray scale parameters. In the whole process, the chroma and the hue value of each of the pixel units of the partition are calculated to adjust the gray scale parameters corresponding to the RGB input signal of the partition, which can significantly improve the color cast image quality of the display interface.

In order to further explain the driving method of the display apparatus of the present disclosure, the specific application examples will be used to explain situations when the gray scale parameter is respectively the gray scale value and the gray scale voltage value.

When the gray scale parameter is the gray scale value, in the application example, the driving method of the display apparatus of the present disclosure includes steps as follows:

One of at least two partitions divided in the display interface is selected, the one is marked as the selected partition (M*N), and the selected partition includes the at least two pixel units;

Average signals $Ave_R_{N*M_i,\ j}$, $Ave_G_{N*M_i,\ j}$, $Ave_B_{N*M_i}$ of all the sub-pixel units $R_{N*M_i,j}$, $G_{N*M_i,\ j}$, $B_{N*M_i}$ (where i, j are pixel units in the N*M partition) in the N*M partition are calculated.

$C_{N*M}$=f1 ($Ave_R_{N*M_i,j}$, $Ave_G_{N*M_i,\ j}$, $Ave_B_{N*M_i}$), $H_{N*M}$=f2 ($Ave_R_{N*M_i,\ j}$, $Ave_G_{N*M_i,j}$, $Ave_B_{N*M_i}$), $L_{N*M}$=f3 ($Ave_R_{N*M_i,j}$, $Ave_G_{N*M_i,j}$, $Ave_B_{N*M_i}$) of the partition are calculated.

R, G, and B initial gray scale values are determined by employing the $C_{N*M}$ and $H_{N*M}$ acquired by calculating the sub-pixels in the section according to the following:

When 0°<H≤45°, or 15°<H≤360°, and CTL1≤C≤CTH2, RGB initial gray scale values of the pixel units are R1, G1, and B1, respectively;

When 45°<H≤135°, and CTL3≤C≤CTH4, the RGB initial gray scale values of the pixel units are R2, G2, and B2, respectively;

When 135°<H≤205°, and CTL5≤C≤CTH6, the RGB initial gray scale values of the pixel units are R3, G3, and B3, respectively;

When 205°<H≤245°, and CTL7≤C≤CTH8, the RGB initial gray scale values of the pixel units are R4, G4, and B4, respectively;

When 245°<H≤295°, and CTL9≤C≤CTH10, the RGB initial gray scale values of the pixel units are R5, G5, and B5, respectively; and When 295°<H≤315°, and CTL11≤C≤CTH12, the RGB initial gray scale values of the pixel units are R6, G6, and B6, respectively; the CTL1 and the CTH2, the CTL3 and the CTH4, the CTL5 and the CTH6, the CTL7 and the CTH8, the CTL9 and the CTH10, and the CTL11 and the CTH12 are respectively color ranges required to be improved, and the color ranges are determined according to preset color cast image quality demand.

When $C_{N*M}$ and $H_{N*M}$ satisfy the hue section of $0°<H_{N*M\leq}45°$ and $315°<H_{N*M\leq}360°$, and the chroma conforms to the range of $CTL1\leq C_{N*M\leq CTH}2$, therefore the initial gray scale of R is defined as R1, the initial gray scale of G is defined as G1, the initial gray scale of B is defined as B1. In the new output signal corresponding to each of the gray scales, such as the initial input signal R is gray scale 2, the new corresponding R signal is f (2, γ, R1, R255). The output gray scale signal, the initial input signal 2, the initial gray scale signal R1, and the termination point output signal R255, and γ affecting full gray scale brightness curve profile are related. The new corresponding R signal is the corresponding function of the four factors, f is a function determined according to the brightness corresponding to the initial gray scale, the brightness corresponding to the termination point signal, and the value γ affecting full gray scale brightness curve profile, i.e., f is the function determined according to the brightness corresponding to the initial gray scale R1, the brightness corresponding to the termination point signal R255, and the value γ affecting full gray scale brightness curve profile. In the practical application, the function f can be firstly acquired according to the brightness corresponding to the initial gray scale R1, the brightness corresponding to the termination point signal R255, and the value γ affecting full gray scale brightness curve profile. Then for the subsequent calculation, the function f can be directly used. Correspondingly, G signal and B signal are also used in the aforementioned manner, and the details are not described herein again.

The gray scale value corresponding to the full gray scale input signal is assigned as output gray scale value corresponding to gray scale in table 1 below, and so on.

| Initial Input Signal (8-bit) | | | New Map Signal (8-bit) | | |
|---|---|---|---|---|---|
| R | G | B | R | G | B |
| 0 | 0 | 0 | R1 | G1 | B1 |
| 1 | 1 | 1 | f (1, γ, R1, R255) | f (1, γ, G1, G255) | f (1, γ, B1, B255) |
| 2 | 2 | 2 | f (2, γ, R1, R255) | f (2, γ, G1, G255) | f (2, γ, B1, B255) |
| 3 | 3 | 3 | f (3, γ, R1, R255) | f (3, γ, G1, G255) | f (3, γ, B1, B255) |
| 4 | 4 | 4 | f (4, γ, R1, R255) | f (4, γ, G1, G255) | f (4, γ, B1, B255) |
| 5 | 5 | 5 | f (5, γ, R1, R255) | f (5, γ, G1, G255) | f (5, γ, B1, B255) |
| 6 | 6 | 6 | f (6, γ, R1, R255) | f (6, γ, G1, G255) | f (6, γ, B1, B255) |
| 7 | 7 | 7 | f (7, γ, R1, R255) | f (7, γ, G1, G255) | f (7, γ, B1, B255) |
| 8 | 8 | 8 | f (8, γ, R1, R255) | f (8, γ, G1, G255) | f (8, γ, B1, B255) |
| 9 | 9 | 9 | f (9, γ, R1, R255) | f (9, γ, G1, G255) | f (9, γ, B1, B255) |
| . . . | . . . | . . . | . . . | . . . | . . . |
| . . . | . . . | . . . | . . . | . . . | . . . |
| . . . | . . . | . . . | . . . | . . . | . . . |
| 244 | 244 | 244 | f (244, γ, R1, R255) | f (244, γ, G1, G255) | f (244, γ, B1, B255) |
| 245 | 245 | 245 | f (245, γ, R1, R255) | f (245, γ, G1, G255) | f (245, γ, B1, B255) |
| 246 | 246 | 246 | f (246, γ, R1, R255) | f (246, γ, G1, G255) | f (246, γ, B1, B255) |
| 247 | 247 | 247 | f (247, γ, R1, R255) | f (247, γ, G1, G255) | f (247, γ, B1, B255) |
| 248 | 248 | 248 | f (248, γ, R1, R255) | f (248, γ, G1, G255) | f (248, γ, B1, B255) |
| 249 | 249 | 249 | f (249, γ, R1, R255) | f (249, γ, G1, G255) | f (249, γ, B1, B255) |
| 250 | 250 | 250 | f (250, γ, R1, R255) | f (250, γ, G1, G255) | f (250, γ, B1, B255) |
| 251 | 251 | 251 | f (251, γ, R1, R255) | f (251, γ, G1, G255) | f (251, γ, B1, B255) |
| 252 | 252 | 252 | f (252, γ, R1, R255) | f (252, γ, G1, G255) | f (252, γ, B1, B255) |
| 253 | 253 | 253 | f (253, γ, R1, R255) | f (253, γ, G1, G255) | f (253, γ, B1, B255) |
| 254 | 254 | 254 | f (254, γ, R1, R255) | f (254, γ, G1, G255) | f (254, γ, B1, B255) |
| 255 | 255 | 255 | 255 | 255 | 255 |

It should be noted that the partition does not refer to a specific one in the above embodiment, that is, the values of i and j can be any value, only the value of i*j is greater than 2, that is, the partition includes the at least two pixel units. When values of i and j are different, the same can be used in the same manner, and the details are not described herein again.

When the gray scale parameter is the gray scale voltage value, in the application example, the driving method of the display apparatus of the present disclosure includes steps as follows:

One of at least two partitions divided in the display interface is selected, the one is marked as a selected partition (N*M), and the selected partition includes at least two pixel units;

Average signals $Ave_R_{N*M_i,j}$, $Ave_G_{N*M_i,j}$, $Ave_B_{N*M_i}$ of all the sub-pixel units $R_{N*M_i,j}$, $G_{N*M_i,j}$, $B_{N*M_i}$ (where i, j are pixel units in the N*M partition) in the N*M partition are calculated.

$C_{N*M}$=f1 ($Ave_R_{N*M_i,j}$, $Ave_G_{N*M_i,j}$, $Ave_B_{N*M_i}$), $H_{N*M}$=f2 ($Ave_R_{N*M_i,j}$, $Ave_G_{N*M_i,j}$, $Ave_B_{N*M_i}$), $L_{N*M}$=f3 ($Ave_R_{N*M_i,j}$, $Ave_G_{N*M_i,j}$, $Ave_B_{N*M_i}$) of the partition are calculated.

R, G, and B initial gray scale voltage values are determined by employing the $C_{N*M}$ and $H_{N*M}$ acquired by calculating the sub-pixels in the section, the specific decision fundaments are as follows:

When 0°<H≤45° or 15°<H≤360°, and CTL1≤C≤CTH2, RGB initial gray scale voltage values of the pixel units are VR1, VG1, and VB1, respectively;

When 45°<H≤135°, and CTL3≤C≤CTH4, the RGB initial gray scale voltage values of the pixel units are VR2, VG2, and VB2, respectively;

When 135°<H≤205°, and CTL5≤C≤CTH6, the RGB initial gray scale voltage values of the pixel units are VR3, VG3, and VB3, respectively;

When 205°<H≤245°, and CTL7≤C≤CTH8, the RGB initial gray scale voltage values of the pixel units are VR4, VG4, and VB4, respectively;

When 245°<H≤295°, and CTL9≤C≤CTH10, the RGB initial gray scale voltage values of the pixel units are VR5, VG5, and VB5, respectively; and When 295°<H≤315°, and CTL11≤C≤CTH12, the RGB initial gray scale voltage values of the pixel units are VR6, VG6, and VB6, respectively; where the CTL1 and the CTH2, the CTL3 and the CTH4, the CTL5 and the CTH6, the CTL7 and the CTH8, the CTL9 and the CTH10, and the CTL11 and the CTH12 are respective color ranges required to be improved, and the color ranges are determined according to preset color cast image quality demand.

When $C_{N*M}$ and $H_{N*M}$ satisfy the hue section of $0°<H_{N*M_}\leq 45°$ and $315°<H_{N*M}\leq 360°$, and the chroma conforms to the range of $CTL1\leq C_{N*M_}\leq CTH2$, the initial gray scale voltage value of R is defined as VR1, the initial gray scale voltage value of G is defined as VG1, and the initial gray scale voltage value of B is defined as VB1.

The gray scale voltage values corresponding to the each of the gray scales in the initial input signal are adjusted according to the initial gray scale voltage determined in the above steps. Specifically, the gray scale voltage value increased for each of the gray scales in the gray scale voltage value corresponding to each of the adjusted gray scales is a difference value between gray scale voltages corresponding to a current gray scale and a previous gray scale in the initial input signal before adjustment. As for the initial input signall, the initial gray scale voltage value corresponding to the initial input signal 1 before adjustment is (V1, V1, V1), therefore the gray scale voltage value corresponding to the input signal 1 before adjustment is (VR1+(V1−V0), VG1+(V1−V0), VB1+(V1−V0)), and so on. Specifically, the gray scale voltage values corresponding to the full gray scale input signal is assigned as shown in Table 2 below.

Figure 7:
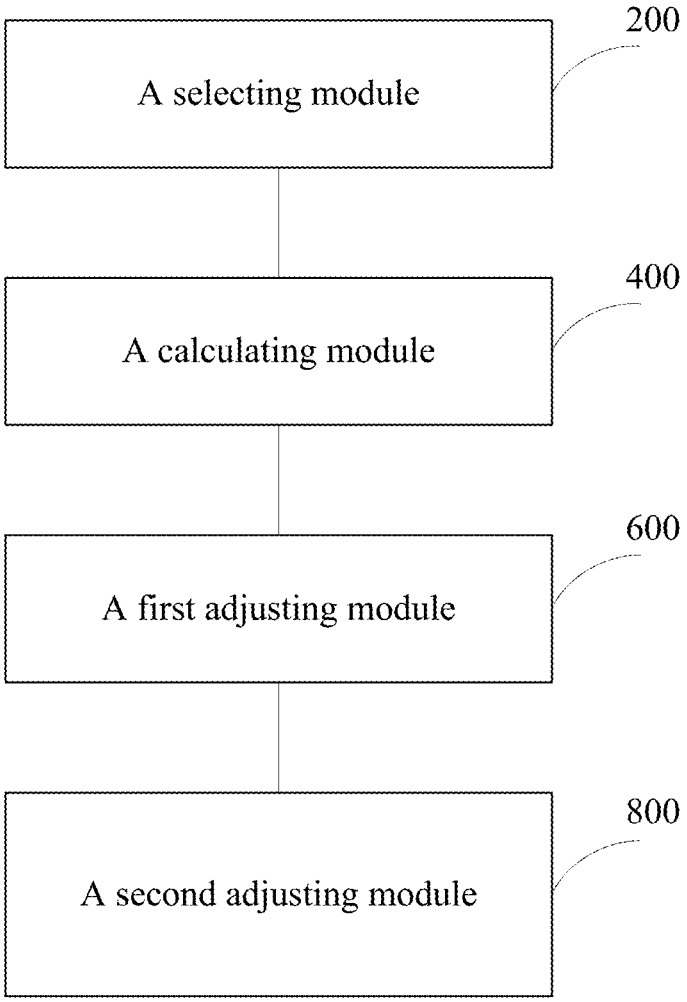
FIG. 7 is a schematic diagram of a driving method for a display apparatus according to one of the embodiments.

Referring to FIG. 7, a driving apparatus of a display apparatus includes:

a selecting module 200 used to select one of at least two partitions divided in a display interface, and used to mark the one as a selected partition, the selected partition includes at least two pixel units;

a calculating unit 400 used to calculate a chroma and a hue value of the selected partition;

a first adjusting module 600 used to adjust RGB initial gray scale parameters of each of the pixel units in the selected partition according to the chroma and the hue value of the selected partition, where the gray scale parameters includes a gray scale value, a gray scale voltage value, or a gray scale current value;

a second adjusting module 800 used to acquire an initial input signal of the selected partition, and used to adjust the gray scale parameters corresponding to the initial input signal according to the initial input signal and the RGB initial gray scale parameters.

| Input | Gray Scale Voltage Values Corresponding To Each Of The Gray Scales In The Initial Input Signal | | | Gray Scale Voltage Values Corresponding To Each Of The Gray Scales In The Adjusted Input Signal | | |
|---|---|---|---|---|---|---|
| Signal | R | G | B | R | G | B |
| 0 | V0 | V0 | V0 | VR1 | VG1 | VB1 |
| 1 | V1 | V1 | V1 | VR1 + (V1 − V0) | VG1 + (V1 − V0) | VB1 + (V1 − V0) |
| 2 | V2 | V2 | V2 | VR1 + (V2 − V1) | VG1 + (V2 − V1) | VB1 + (V2 − V1) |
| 3 | V3 | V3 | V3 | VR1 + (V3 − V2) | VG1 + (V3 − V2) | VB1 + (V3 − V2) |
| 4 | V4 | V4 | V4 | VR1 + (V4 − V3) | VG1 + (V4 − V3) | VB1 + (V4 − V3) |
| 5 | V5 | V5 | V5 | VR1 + (V5 − V4) | VG1 + (V5 − V4) | VB1 + (V5 − V4) |
| 6 | V6 | V6 | V6 | VR1 + (V6 − V5) | VG1 + (V6 − V5) | VB1 + (V6 − V5) |
| 7 | V7 | V7 | V7 | VR1 + (V7 − V6) | VG1 + (V7 − V6) | VB1 + (V7 − V6) |
| 8 | V8 | V8 | V8 | VR1 + (V8 − V7) | VG1 + (V8 − V7) | VB1 + (V8 − V7) |
| 9 | V9 | V9 | V9 | VR1 + (V9 − V8) | VG1 + (V9 − V8) | VB1 + (V9 − V8) |
| . . . | . . . | . . . | . . . | . . . | . . . | . . . |
| . . . | . . . | . . . | . . . | . . . | . . . | . . . |
| . . . | . . . | . . . | . . . | . . . | . . . | . . . |
| 244 | V244 | V244 | V244 | VR1 + (V244 − V243) | VG1 + (V244 − V243) | VB1 + (V244 − V243) |
| 245 | V245 | V245 | V245 | VR1 + (V245 − V244) | VG1 + (V245 − V244) | VB1 + (V245 − V244) |
| 246 | V246 | V246 | V246 | VR1 + (V246 − V245) | VG1 + (V246 − V245) | VB1 + (V246 − V245) |
| 247 | V247 | V247 | V247 | VR1 + (V247 − V246) | VG1 + (V247 − V246) | VB1 + (V247 − V246) |
| 248 | V248 | V248 | V248 | VR1 + (V248 − V247) | VG1 + (V248 − V247) | VB1 + (V248 − V247) |
| 249 | V249 | V249 | V249 | VR1 + (V249 − V248) | VG1 + (V249 − V248) | VB1 + (V249 − V248) |
| 250 | V250 | V250 | V250 | VR1 + (V250 − V249) | VG1 + (V250 − V249) | VB1 + (V250 − V249) |
| 251 | V251 | V251 | V251 | VR1 + (V251 − V250) | VG1 + (V251 − V250) | VB1 + (V251 − V250) |
| 252 | V252 | V252 | V252 | VR1 + (V252 − V251) | VG1 + (V252 − V251) | VB1 + (V252 − V251) |
| 253 | V253 | V253 | V253 | VR1 + (V253 − V252) | VG1 + (V253 − V252) | VB1 + (V253 − V252) |
| 254 | V254 | V254 | V254 | VR1 + (V254 − V253) | VG1 + (V254 − V253) | VB1 + (V254 − V253) |
| 255 | V255 | V255 | V255 | V255 | V255 | V255 |

According to the driving apparatus of a display apparatus, one of the at least two partitions divided in the display interface is selected by the selecting module 200 to mark the one as the selected partition. The chroma and the hue value of the selected partition are calculated by the calculating module 400. The RGB initial gray scale parameters of each of the pixel units in the selected partition are adjusted by the first adjusting module 600 according to the chroma and the hue value of the selected partition. The initial input signal of the selected partition is acquired, and the gray scale parameters corresponding to the initial input signal are adjusted by the second adjusting module 800 according to the initial input signal and the RGB initial gray scale parameters. In the whole process, the chroma and the hue value of each of the pixel units of the partition are calculated to adjust the gray scale parameters corresponding to the RGB input signal of the partition, which can significantly improve the color cast image quality of the display interface.

Figure 8:
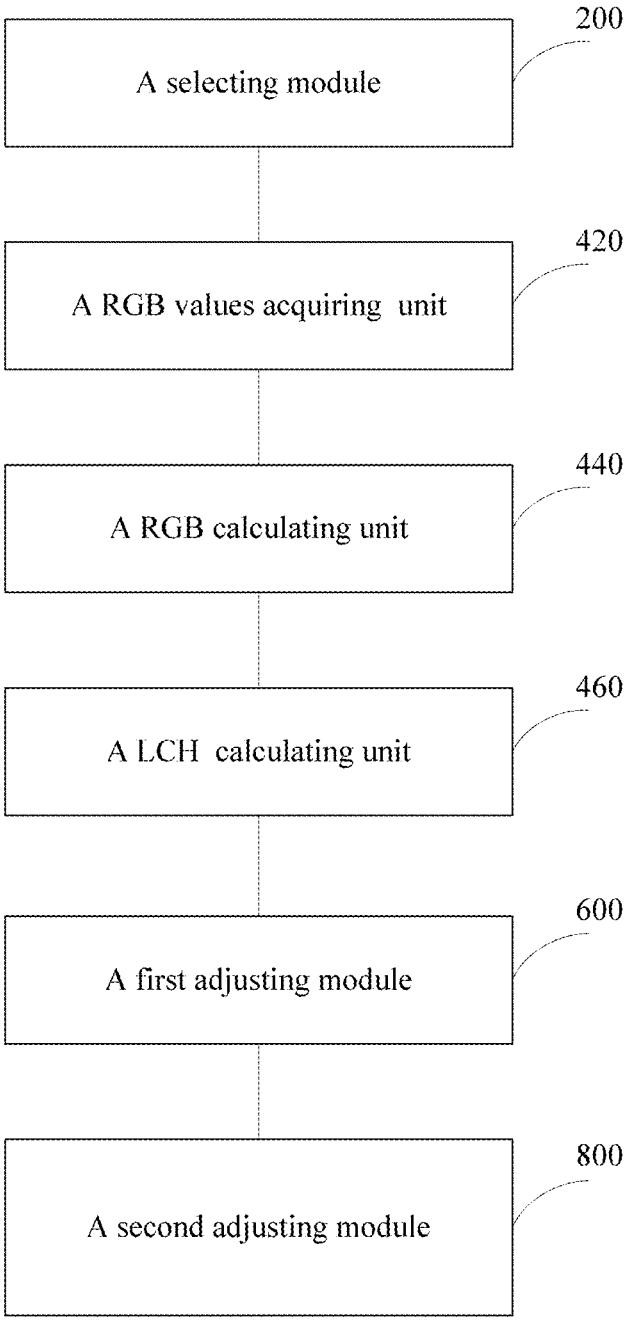
FIG. 8 is a schematic diagram of a driving method for a display apparatus according to one of the embodiments.

Referring to FIG. 8, according to an embodiment, the calculating unit 400 includes:

A RGB value acquiring unit 420 used to acquire RGB values of each of the pixel units in the selected partition;

A RGB value calculating unit 440 used to calculate average value of the RGB of each of the pixel units in the selected partition;

A LCH calculating unit 460 used to calculate a chroma and a hue value of the selected partition according to the RGB average value.

According to an embodiment, the formula of the LCH calculating unit 460 calculating the chroma and the hue value of the selected partition according to the average value of the RGB is:

$$C=f2\{\text{Ave } R,\text{Ave } G,\text{Ave } B\}$$

$$H=f3\{\text{Ave } R,\text{Ave } G,\text{Ave } B\}$$

In the functional expression, Ave R, Ave G, and Ave B are respectively average values of RGB. f2 is a calculation function of chroma C in a brightness-chroma-hue model, and f3 is a calculation function of hue H in the brightness-chroma-hue model.

According to an embodiment, the gray scale parameter is the gray scale value. The specific process of the first adjusting module 600 adjusting RGB initial gray scale parameters of each of the pixel units in the selected partition according to the chroma and the hue value of the selected partition includes:

When $0°<H\leq 45°$ or $15°<H\leq 360°$, and $CTL1\leq C\leq CTH2$, the RGB initial gray scale values of the pixel units are R1, G1, and B1, respectively;

When $45°<H\leq 135°$, and $CTL3\leq C\leq CTH4$, the RGB initial gray scale values of the pixel units are R2, G2, and B2, respectively;

When $135°<H\leq 205°$, and $CTL5\leq C\leq CTH6$, the RGB initial gray scale values of the pixel units are R3, G3, and B3, respectively;

When $205°<H\leq 245°$, and $CTL7\leq C\leq CTH8$, the RGB initial gray scale values of the pixel units are R4, G4, and B4, respectively;

When $245°<H\leq 295°$, and $CTL9\leq C\leq CTH10$, the RGB initial gray scale values of the pixel units are R5, G5, and B5, respectively; and When $295°<H\leq 315°$, and $CTL11\leq C\leq CTH12$, the RGB initial gray scale values of the pixel units are R6, G6, and B6, respectively; where the CTL1 and the CTH2, the CTL3 and the CTH4, the CTL5 and the CTH6, the CTL7 and the CTH8, the CTL9 and the CTH10, and the CTL11 and the CTH12 are respectively color ranges required to be improved, and the color ranges are determined according to preset color cast image quality demand.

According to an embodiment, the gray scale parameter is the gray scale value, the second adjusting module 800 is further used to:

identify an initial gray scale value and a termination point signal corresponding to the initial input signal;

determine the gray scale value corresponding to the adjusted initial input signal as f {the initial gray scale value, γ, initial gray scale value, the termination point signal} according to the initial gray scale value and the termination point signal corresponding to the initial input signal, and RGB initial gray scale values, where γ is a value affecting full gray scale brightness curve profile.

According to an embodiment, the gray scale parameter is the gray scale voltage value. The specific process of the first adjusting module 600 adjusting the RGB initial gray scale parameters of each of the pixel units in the selected partition according to the chroma and the hue value of the selected partition includes:

When $0°<H\leq 45°$ or $15°<H\leq 360°$, and $CTL1\leq C\leq CTH2$, RGB initial gray scale voltage values of the pixel units are VR1, VG1, and VB1, respectively;

When $45°<H\leq 135°$, and $CTL3\leq C\leq CTH4$, the RGB initial gray scale voltage values of the pixel units are VR2, VG2, and VB2, respectively;

When $135°<H\leq 205°$, and $CTL5\leq C\leq CTH6$, the RGB initial gray scale voltage values of the pixel units are VR3, VG3, and VB3, respectively;

When $205°<H\leq 245°$, and $CTL7\leq C\leq CTH8$, the RGB initial gray scale voltage values of the pixel units are VR4, VG4, and VB4, respectively;

When $245°<H\leq 295°$, and $CTL9\leq C\leq CTH10$, the RGB initial gray scale voltage values of the pixel units are VR5, VG5, and VB5, respectively; and When $295°<H\leq 315°$, and $CTL11\leq C\leq CTH12$, the RGB initial gray scale voltage values of the pixel units are VR6, VG6, and VB6, respectively; where the CTL1 and the CTH2, the CTL3 and the CTH4, the CTL5 and the CTH6, the CTL7 and the CTH8, the CTL9 and the CTH10, and the CTL11 and the CTH12 are respective color ranges required to be improved, and the color ranges are determined according to preset color cast image quality demand.

According to an embodiment, the gray scale parameter is the gray scale voltage value, and the gray scale voltage value increased for each of the gray scales in the gray scale voltage value corresponding to each of the gray scales adjusted by the second adjusting module 800 is a difference value between gray scale voltages corresponding to a current gray scale and a previous gray scale in the initial input signal before adjustment.

In an alternative embodiment, a driving apparatus of a display apparatus is provided, which includes:

a dividing module used to divide a display interface into at least two partitions, each of the partitions includes i*j pixel units, where i and j are positive integers, and i*j is greater than or equals to 2;

a selecting module used to select one of at least two partitions divided in the display interface, and used to mark the one as a selected partition, the selected partition includes at least two pixel units;

an acquiring unit used to acquire a RGB value of each of the pixel units in the selected partition;

an average value calculating unit used to calculate a RGB average value of each of the pixel units in the selected partition;

a chroma and a hue value calculating unit used to calculate the chroma and the hue value of the selected partition according to the average value of RGB.

a first adjusting module used to adjust RGB initial gray scale values of each of the pixel units in the selected partition according to the chroma and the hue value of the selected partition;

a second adjusting module used to acquire an initial input signal of the selected partition, and used to adjust the gray scale value corresponding to the initial input signal according to the initial input signal and the RGB initial gray scale value.

Figure 9:
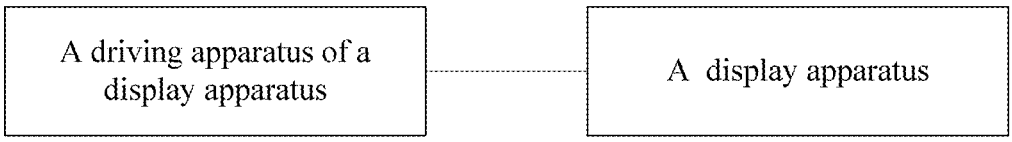
FIG. 9 is a block diagram of a driving method for a display apparatus according to one of the embodiments.

It is to be understood that the driving method and apparatus for the display apparatus can be applied to various types for display apparatus, as FIG. 9 indicated. Specifically, the display apparatus can be any type for display apparatus, such as an LCD apparatus, an OLED apparatus, a Quantum Dot Light Emitting Diodes (QLED) display apparatus or a curved display apparatus.

Although the invention is illustrated and described herein with reference to specific embodiments, the invention is not intended to be limited to the details shown. It should be noted that any variation or replacement readily figured out by a person skilled in the art within the technical scope disclosed in the present invention shall all fall within the protection scope of the present invention. Therefore, the protection scope of the present invention shall be subject to the protection scope of the appended claims.

What is claimed is:

1. A driving method for a display apparatus, comprising:

selecting one of at least two partitions divided in a display interface, and marking the one as a selected partition, wherein the selected partition comprises at least two pixel units;

calculating a chroma and a hue value of the selected partition;

adjusting initial gray scale parameters of sub-pixel units of each of the pixel units, comprising at least one of a gray scale value, a gray scale voltage value, and a gray scale current value, in the selected partition according to the chroma and the hue value of the selected partition; and acquiring an initial input signal of the selected partition, and adjusting gray scale parameters corresponding to the initial input signal according to the initial input signal and the initial gray scale parameters of the sub-pixel units, wherein the gray scale value, the gray scale voltage value, and the gray scale current value have mutual correspondence; one gray scale value respectively and accurately corresponds to one gray scale voltage value and one gray scale current value, the one gray scale voltage value respectively and accurately corresponds to the one gray scale value and one gray scale current value, and the one gray scale current value respectively and accurately corresponds to the one gray scale value and the one gray scale voltage value.

2. The method according to claim 1, wherein all of the partitions in the display interface have the same number of pixel units.

3. The method according to claim 1, wherein the step of calculating the chroma and the hue value of the selected partition comprises:

acquiring a sub-pixel unit value of each of the pixel units in the selected partition;

calculating an average value of the sub-pixel units of each of the pixel units in the selected partition; and calculating the chroma and the hue value of the selected partition according to the average value of the sub-pixel units.

4. The method according to claim 3, wherein a functional expression of calculating the chroma and the hue value of the selected partition according to the average value of the sub-pixel units is:

$$C=f2\{\text{Ave } R,\text{Ave } G,\text{Ave } B\}$$

$$H=f3\{\text{Ave } R,\text{Ave } G,\text{Ave } B\}$$

wherein Ave R, Ave G, and Ave B are an average value of red sub-pixel units, an average value of green sub-pixel units, and an average value of blue sub-pixel units, respectively; f2 is a calculation function of chroma C in a brightness-chroma-hue model, and f3 is a calculation function of hue H in the brightness-chroma-hue model.

5. The method according to claim 1, wherein the gray scale parameter is the gray scale value, and the step of adjusting the initial gray scale parameters of the sub-pixel units of each of the pixel units in the selected partition according to the chroma and the hue value of the selected partition comprises:

when $0°<H\leq 45°$ or $15°<H\leq 360°$, and $CTL1\leq C\leq CTH2$, initial gray scale values of the sub-pixel units of the pixel units are R1, G1, and B1, respectively;

when $45°<H\leq 135°$, and $CTL3\leq C\leq CTH4$, the initial gray scale values of the sub-pixel units of the pixel units are R2, G2, and B2, respectively;

when $135°<H\leq 205°$, and $CTL5\leq C\leq CTH6$, the initial gray scale values of the sub-pixel units of the pixel units are R3, G3, and B3, respectively;

when $205°<H\leq 245°$, and $CTL7\leq C\leq CTH8$, the initial gray scale values of the sub-pixel units of the pixel units are R4, G4, and B4, respectively;

when $245°<H\leq 295°$, and $CTL9\leq C\leq CTH10$, the initial gray scale values of the sub-pixel units of the pixel units are R5, G5, and B5, respectively; and when $295°<H\leq 315°$, and $CTL11\leq C\leq CTH12$, the initial gray scale values of the sub-pixel units of the pixel units are R6, G6, and B6, respectively; wherein the CTL1 and the CTH2, the CTL3 and the CTH4, the CTL5 and the CTH6, the CTL7 and the CTH8, the CTL9 and the CTH10, and the CTL11 and the CTH12 are respectively color ranges required to be improved, and the color ranges are determined according to preset color cast image quality demand.

6. The method according to claim 1, wherein the gray scale parameter is the gray scale value, and the step of adjusting the gray scale parameters corresponding to the initial input signal according to the initial input signal and the initial gray scale parameters of the sub-pixel units comprises:

identifying an initial gray scale value and a termination point signal corresponding to the initial input signal; and determining the gray scale value corresponding to the adjusted initial input signal as f {the initial gray scale value, γ, initial gray scale value, the termination point signal} according to the initial gray scale value and the termination point signal corresponding to the initial input signal, and initial gray scale values of the sub-pixel units, wherein γ is a value affecting full gray scale brightness curve profile, f is a preset function determined according to a brightness corresponding to the initial gray scale, a brightness corresponding to the termination point signal, and the value γ affecting the full gray scale brightness curve profile.

7. The method according to claim 1, wherein the gray scale parameter is the gray scale voltage value, and the step of adjusting the initial gray scale parameters of the sub-pixel units of each of the pixel units in the selected partition according to the chroma and the hue value of the selected partition comprises:

when $0° < H \leq 45°$ or $15° < H \leq 360°$, and $CTL1 \leq C \leq CTH2$, the initial gray scale voltage values of the sub-pixel units of the pixel units are VR1, VG1, and VB1, respectively;

when $45° < H \leq 135°$, and $CTL3 \leq C \leq CTH4$, the initial gray scale voltage values of the sub-pixel units of the pixel units are VR2, VG2, and VB2, respectively;

when $135° < H \leq 205°$, and $CTL5 \leq C \leq CTH6$, the initial gray scale voltage values of the sub-pixel units of the pixel units are VR3, VG3, and VB3, respectively;

when $205° < H \leq 245°$, and $CTL7 \leq C \leq CTH8$, the initial gray scale voltage values of the sub-pixel units of the pixel units are VR4, VG4, and VB4, respectively;

when $245° < H \leq 295°$, and $CTL9 \leq C \leq CTH10$, the initial gray scale voltage values of the sub-pixel units of the pixel units are VR5, VG5, and VB5, respectively; and when $295° < H \leq 315°$, and $CTL11 \leq C \leq CTH12$, the initial gray scale voltage values of the sub-pixel units of the pixel units are VR6, VG6, and VB6, respectively; wherein the CTL1 and the CTH2, the CTL3 and the CTH4, the CTL5 and the CTH6, the CTL7 and the CTH8, the CTL9 and the CTH10, and the CTL11 and the CTH12 are respective color ranges required to be improved, and the color ranges are determined according to preset color cast image quality demand.

8. The method according to claim 1, wherein the gray scale parameter is the gray scale voltage value, and the step of adjusting the gray scale parameter corresponding to the initial input signal according to the initial input signal and the initial gray scale of the sub-pixel units comprise:

acquiring gray scale voltage value corresponding to full gray scale of the initial input signal according to the acquired initial input signal of the selected partition, and adjusting gray scale voltage corresponding to each of gray scales of the initial input signal according to the initial gray scale voltage value of the adjusted sub-pixel units.

9. The method according to claim 1, wherein the gray scale parameter is the gray scale voltage value, and the gray scale voltage value increased for each of the gray scales in the gray scale voltage value corresponding to each of the adjusted gray scales is a difference value between gray scale voltages corresponding to a current gray scale and a previous gray scale in the initial input signal before adjustment.

10. The method according to claim 1, wherein prior to the step of selecting one of the at least two partitions divided in the display interface, the method further comprises:

dividing the display interface into the at least two partitions, each of the partitions includes i*j pixel units, wherein i and j are positive integers, and i*j is greater than or equals to 2.

11. A driving apparatus of a display apparatus, comprising:

a selecting module configured to select one of at least two partitions divided in a display interface, and configured to mark the one as a selected partition, wherein the selected partition comprises at least two pixel units;

a calculating unit configured to calculate a chroma and a hue value of the selected partition;

a first adjusting module configured to adjust initial gray scale parameters of sub-pixel units, comprising at least one of a gray scale value, a gray scale voltage value, and a gray scale current value, of each of the pixel units in the selected partition according to the chroma and the hue value of the selected partition; and a second adjusting module configured to acquire an initial input signal of the selected partition, and configured to adjust the gray scale parameters corresponding to the initial input signal according to the initial input signal and the initial gray scale parameters of the sub-pixel units, wherein the gray scale value, the gray scale voltage value, and the gray scale current value have mutual correspondence; one gray scale value respectively and accurately corresponds to one gray scale voltage value and one gray scale current value, the one gray scale voltage value respectively and accurately corresponds to the one gray scale value and one gray scale current value, and the one gray scale current value respectively and accurately corresponds to the one gray scale value and the one gray scale voltage value.

12. The driving apparatus of the display apparatus according to claim 11, wherein the calculating module comprises:

a sub-pixel unit value acquiring unit configured to acquire a sub-pixel unit value of each of the pixel units in the selected partition;

a sub-pixel unit calculating unit configured to calculate an average value of the sub-pixel units of each of the pixel units in the selected partition; and a chroma and a hue value calculating unit configured to calculate a chroma and a hue value of the selected partition according to the average value of the sub-pixel units.

13. The driving apparatus of the display apparatus according to claim 11, wherein the gray scale parameter is the gray scale value, and the process of the first adjusting module adjusting the initial gray scale parameters of the sub-pixel units of each of the pixel units in the selected partition according to the chroma and the hue value of the selected partition comprises:

when $0° < H \leq 45°$ or $15° < H \leq 360°$, and $CTL1 \leq C \leq CTH2$, RGB initial gray scale values of the pixel units are R1, G1, and B1, respectively;

when $45° < H \leq 135°$, and $CTL3 \leq C \leq CTH4$, the RGB initial gray scale values of the pixel units are R2, G2, and B2, respectively;

when $135° < H \leq 205°$, and $CTL5 \leq C \leq CTH6$, the RGB initial gray scale values of the pixel units are R3, G3, and B3, respectively;

when $205° < H \leq 245°$, and $CTL7 \leq C \leq CTH8$, the RGB initial gray scale values of the pixel units are R4, G4, and B4, respectively;

when $245° < H \leq 295°$, and $CTL9 \leq C \leq CTH10$, the RGB initial gray scale values of the pixel units are R5, G5, and B5, respectively; and when $295° < H \leq 315°$, and $CTL11 \leq C \leq CTH12$, the RGB initial gray scale values of the pixel units are R6, G6, and B6, respectively; wherein the CTL1 and the CTH2, the CTL3 and the CTH4, the CTL5 and the CTH6, the CTL7 and the CTH8, the CTL9 and the CTH10, and the CTL11 and the CTH12 are respectively color ranges required to be improved, and the color ranges are determined according to preset color cast image quality demand.

14. The driving apparatus of the display apparatus according to claim 11, wherein the gray scale parameter is the gray scale voltage value, and the process of the first adjusting module adjusting the initial gray scale parameters of the sub-pixel units of each of the pixel units in the selected partition according to the chroma and the hue value of the selected partition comprises:

when $0° < H \leq 45°$ or $15° < H \leq 360°$, and $CTL1 \leq C \leq CTH2$, RGB initial gray scale voltage values of the pixel units are VR1, VG1, and VB1, respectively;

when $45° < H \leq 135°$, and $CTL3 \leq C \leq CTH4$, the RGB initial gray scale voltage values of the pixel units are VR2, VG2, and VB2, respectively;

when $135° < H \leq 205°$, and $CTL5 \leq C \leq CTH6$, the RGB initial gray scale voltage values of the pixel units are VR3, VG3, and VB3, respectively;

when $205° < H \leq 245°$, and $CTL7 \leq C \leq CTH8$, the RGB initial gray scale voltage values of the pixel units are VR4, VG4, and VB4, respectively;

when $245° < H \leq 295°$, and $CTL9 \leq C \leq CTH10$, the RGB initial gray scale voltage values of the pixel units are VR5, VG5, and VB5, respectively; and when $295° < H \leq 315°$, and $CTL11 \leq C \leq CTH12$, the RGB initial gray scale voltage values of the pixel units are VR6, VG6, and VB6, respectively; wherein the CTL1 and the CTH2, the CTL3 and the CTH4, the CTL5 and the CTH6, the CTL7 and the CTH8, the CTL9 and the CTH10, and the CTL11 and the CTH12 are respective color ranges required to be improved, and the color ranges are determined according to preset color cast image quality demand.

15. The driving apparatus of the display apparatus according to claim 11, wherein the gray parameter is the gray scale value, and the calculating module is configured to:

identify an initial gray scale value and a termination point signal corresponding to the initial input signal; and determine the gray scale value corresponding to the adjusted initial input signal as f {the initial gray scale value, γ, the initial gray scale value, the termination point signal} according to the initial gray scale value and the termination point signal corresponding to the initial input signal, and initial gray scale values of the sub-pixel units, wherein γ is a value affecting full gray scale brightness curve profile, f is a preset function determined according to a brightness corresponding to the initial gray scale, a brightness corresponding to the termination point signal, and the value γ affecting the full gray scale brightness curve profile.

16. A driving apparatus of a display apparatus, comprising:

a dividing module configured to divide a display interface into at least two partitions, each of the partitions includes i*j pixel units, wherein i and j are positive integers, and i*j is greater than or equals to 2;

a selecting module configured to select one of the at least two partitions divided in the display interface, and configured to mark the one as a selected partition, the selected partition comprising at least two pixel units;

an acquiring unit configured to acquire a sub-pixel unit value of each of the pixel units in the selected partition;

an average value calculating unit configured to calculate an average value of the sub-pixel units of each of the pixel units in the selected partition; and a chroma and a hue value calculating unit configured to calculate the chroma and the hue value of the selected partition according to the average value of the sub-pixel units;

a first adjusting module configured to adjust initial gray scale value of the sub-pixel units of each of the pixel units in the selected partition according to the chroma and the hue value of the selected partition; and a second adjusting module configured to acquire an initial input signal of the selected partition, and configured to adjust the gray scale value corresponding to the initial input signal according to the initial input signal and the initial gray scale value of the sub-pixel units, wherein the gray scale value, a gray scale voltage value, and a gray scale current value have mutual correspondence; one gray scale value respectively and accurately corresponds to one gray scale voltage value and one gray scale current value, the one gray scale voltage value respectively and accurately corresponds to the one gray scale value and one gray scale current value, and the one gray scale current value respectively and accurately corresponds to the one gray scale value and the one gray scale voltage value.

* * * * *